US010514235B1

(12) United States Patent
McCauley et al.

(10) Patent No.: US 10,514,235 B1
(45) Date of Patent: Dec. 24, 2019

(54) TAPE SWITCH MOUNTING BRACKET FOR FIREARM

(71) Applicants: Sean McCauley, Newburgh, IN (US); Eric Small, Alabaster, AL (US)

(72) Inventors: Sean McCauley, Newburgh, IN (US); Eric Small, Alabaster, AL (US)

( * ) Notice: Subject to any disclaimer, the term of this patent is extended or adjusted under 35 U.S.C. 154(b) by 0 days.

(21) Appl. No.: 15/925,442

(22) Filed: Mar. 19, 2018

Related U.S. Application Data

(63) Continuation-in-part of application No. 15/240,507, filed on Aug. 18, 2016, now Pat. No. 9,966,204.

(51) Int. Cl.
*F41G 11/00* (2006.01)
*H01H 9/02* (2006.01)
*F41G 1/34* (2006.01)

(52) U.S. Cl.
CPC ..... *F41G 11/003* (2013.01); *H01H 9/02* (2013.01); *F41G 1/34* (2013.01)

(58) Field of Classification Search
CPC ..... H01H 9/02; F41G 11/003; F41G 11/34
USPC ..... 42/90, 119
See application file for complete search history.

(56) References Cited

U.S. PATENT DOCUMENTS 6,568,118 B1 * 5/2003 Teetzel ..... F41G 1/36 42/105
7,199,315 B1 * 4/2007 Sharrah ..... F41A 17/06 200/511
7,243,454 B1 * 7/2007 Cahill ..... F41C 23/12 42/72
7,845,105 B1 * 12/2010 Cahill ..... F41C 23/16 200/86 R
8,341,866 B1 * 1/2013 Gaddini ..... F41G 11/003 42/71.01
9,784,536 B2 * 10/2017 Boswell ..... F41G 11/004
2005/0243542 A1 * 11/2005 Kim ..... F41G 1/34 362/110
2007/0235298 A1 * 10/2007 Kim ..... F41G 1/34 200/18
2009/0044439 A1 * 2/2009 Phillips ..... F41C 23/14 42/72
2010/0205795 A1 * 8/2010 Moody ..... F41A 23/08 29/428
2011/0167703 A1 * 7/2011 Deros ..... F41G 11/003 42/90
2012/0055061 A1 * 3/2012 Hartley ..... F41C 23/16 42/84
2012/0266514 A1 * 10/2012 Michal ..... F41C 23/16 42/90
2013/0318851 A1 * 12/2013 Diamond ..... F41C 27/00 42/90
2016/0211095 A1 * 7/2016 Zimmer ..... F41C 27/00

* cited by examiner

*Primary Examiner* — John Cooper

(57) ABSTRACT

The present invention relates to tape switch mounting bracket for use with a firearm comprising of a one-piece mounting bracket with at least two (2) parallel opposite first and second ends, a switch slot adapted to receive a tape switch, a rail attachment feature adapted to mount to a variety of rail mounting systems, and at least one cable passage adapted to receive a cable of the tape switch. The cable passage configured to receive, contain and manage the tape switch cable during application.

16 Claims, 6 Drawing Sheets

TAPE SWITCH MOUNTING BRACKET FOR FIREARM

CROSS REFERENCES TO RELATED APPLICATIONS

This application claims the benefit of co-pending U.S. patent application Ser. No. 15/240,507 filed Aug. 18, 2016, with title "Tape Switch Mounting Bracket for Firearm."

STATEMENT AS TO RIGHTS OF INVENTIONS MADE UNDER FEDERALLY SPONSORED RESEARCH DEVELOPMENT

Not Applicable

BACKGROUND OF THE INVENTION

1. Field of the Invention

This invention relates to a tape switch mounting bracket for a firearm comprising of a one piece mounting bracket with at least two (2) parallel opposite first and second ends, switch slot, rail attachment feature, at least four (4) apertures, and whereby the switch slot has an indentation with at least one rounded rectangular third end and an overhang on said first and second ends and said third end and is adapted to receive a tape switch; whereby the rail attachment feature can be configured to fit a variety of rail mounting systems; whereby at least (2) apertures are adapted for receiving screws to attach said mounting bracket to said rail mounting system and whereby at least two apertures are adapted for receiving additional tape switch operated accessories.

2. Background Information

Many individuals use firearms with tape switch or pressure switch accessories. The use of these accessories requires that the tape switch be attached to the firearm in some manner, and the use of tape switch attachments on firearms is known in the prior art.

Typically, tape switches are attached to firearms by the use of adhesive backed hook and loop strips, wire, wire ties, or rubber bands. These means of attachment do not hold the tape switch in a secure or constant position and can easily be snagged on clothing or other obstructions and therefore allow the tape switch to move, creating an inconsistent tape switch position issue for an end user. The end user requires the tape switch to remain in a constant fixed position. Further, these means of attachment make moving the tape switch to a different location on the firearm or to a different firearm difficult or cumbersome. The present invention addresses these problems and discloses a tape switch mounting bracket which securely holds a tape switch in a constant position and allows the end user to remove or replace a damaged tape switch easily without removing the tape switch mounting bracket and makes moving the tape switch to a different position on the firearm simple. Thus, there is a need for a tape switch mounting bracket for a firearm.

As will be seen from the subsequent description, the preferred embodiments of the present invention overcome the problems and difficulties of the known prior art.

SUMMARY OF THE INVENTION

Many individuals use firearms with tape switch or pressure switch accessories such as lights which must be attached to a firearm in some manner. The current means to attach tape switch accessories do not hold the tape switch in a secure or constant position. This is particularly important for end users using a tape switch light accessory in a low-light or dark environment. Further, these current means of attachment make moving the tape switch to a different location on the firearm or to a different firearm difficult.

The present invention relates to tape switch mounting bracket for use with a firearm comprising of a one-piece mounting bracket with at least two (2) parallel opposite first and second ends, switch slot, rail attachment feature, a plurality of apertures, and whereby the switch slot is adapted to receive a tape switch; and whereby the rail attachment feature is adapted to mount to a variety of rail mounting systems. The preferred embodiment includes a tape switch mounting bracket with a switch slot comprising of an indention with at least one rounded rectangular third end and an overhang on said first and second ends and said third end.

The mounting bracket further includes one or more cable passages adapted to receive, contain and manage the flexible cable of the tape switch. The cable passages are parallel to a longitudinal axis of the mounting bracket and extends the length of the mounting bracket. The cable passage defines a first opening, a second, opposite opening and a central exit in communication with the channel that is disposed between the first and second openings.

The section beneath or at an adjacent angle to the switch slot comprises of a rail attachment feature to mount the tape switch bracket to a variety of rail mounting systems. These mounting features include specific shapes and dimensions as required by their original designers to attach various types of equipment and brackets to the mounting rail, One type of mounting system is MIL-STD 1913 or Picatinny accessory mounting rail for small arms. A second type of mounting system is KeyMod developed by VLTOR Weapon Systems of Tucson, Ariz., and yet a third type of mounting system is M-Lok developed by Magpul Industries, Each rail mounting system has its own unique fastening method and requires some standard and some specialized fasteners to hold the tape switch bracket secure to the rail mounting system. These three mounting rail systems are noted as the three most prevalent rail mounting systems in the firearm industry. The art work in the patent shows the tape switch bracket attached to these three rail mounting systems but is not intended to account for all rail mounting systems in the firearm industry. Moreover the patent intent is to provide a secure method of mounting a tape switch.

DESCRIPTION OF THE PREFERRED EMBODIMENTS

In accordance with the present invention, a tape switch mounting bracket for firearm is disclosed.

Figure 1:
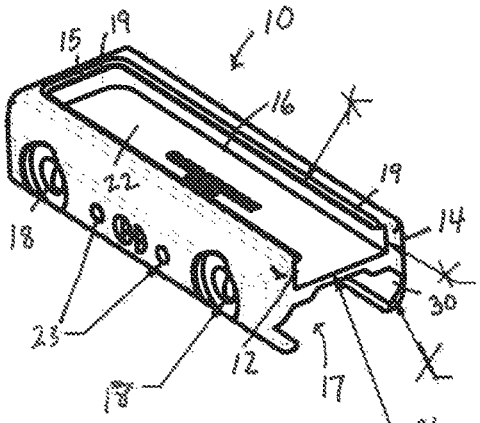
FIG. 1 is a perspective view of the present invention, a tape switch mounting bracket for use with a firearm.
Figure 2:
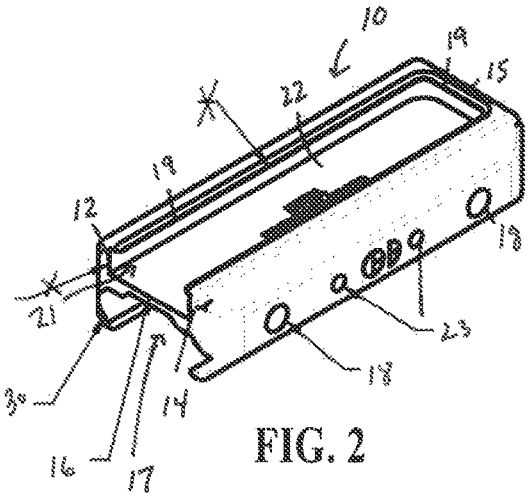
FIG. 2 also illustrates the tape switch mounting bracket for use with a firearm and its preferred embodiments.

FIGS. 1 and 2 illustrate a preferred embodiment of the tape switch mounting bracket for a firearm. The apparatus generally includes a one-piece mounting bracket 10 with at least two parallel opposite first and second ends 12, 14, switch slot 16, rail attachment feature 17, at least four (4) apertures, and whereby the switch slot 16 is adapted to receive a tape switch 20; and whereby the rail attachment feature 17 is adapted to mount to a variety of rail mounting systems 100. The apparatus allows an end user to insert a tape switch 20 into the switch slot 16 and attach the tape switch mounting bracket 10 securely to a variety of rail mounting system 100 on a firearm as best shown in FIGS. 3, 4, 5 and 6.

As illustrated, the switch slot 20 consists of the switch slot 16 on the top side of the tape switch mounting bracket 10 between the first and second opposite ends 12, 14 and with at least one rounded rectangular third end 15. An overhang 19 on said first and second ends and said third end allows for the switch slot 16 to hold the tape switch 20 securely and prevents the tape switch 20 from moving laterally in three directions. The switch slot 16 can be sized to hold a specific manufacture's tape switch with friction to prevent movement in the fourth lateral direction towards the switch slot open end 21. Further, the overhang 19 of the switch slot 16 retains the tape switch 20 inside the switch slot 16 and prevents upward travel. The preferred overhang profile is slim so as not to impede operation of the tape switch 20 which is activated by tactile contact with a finger or thumb.

The bottom surface or base 22 of the switch slot provides a foundation support for the tape switch 20 and allows for separation between the tape switch 20 and the rail mounting system surface. The distance between the bottom of the switch slot and the underside of the overhang are sized to hold the specific manufacture's tape switch with friction to prevent movement.

The tape switch 20 may be used to operate electrically powered known firearm accessories (e.g., lasers, illumination tools, and the like). The tape switch 20 is conductively connected to a firearm accessory by a flexible cable 25 having a connector thereon. In this way, the tape switch 20 may be remotely positioned relative to the firearm accessory to which it is attached.

The cable 25 is used to conductively connect the tape switch 20 to an electrically powered accessory 110. In order to manage and maintain placement of the cable(s) 25 during application, the mounting bracket 10 includes one or more cable passages 30 that define a channel 30A (see FIG. 7) adapted to receive the cable 25. Each of the one or more cable passages 30 is generally parallel to a longitudinal axis 5 (FIG. 7) and extends the length of the mounting bracket 10.

Figure 8:
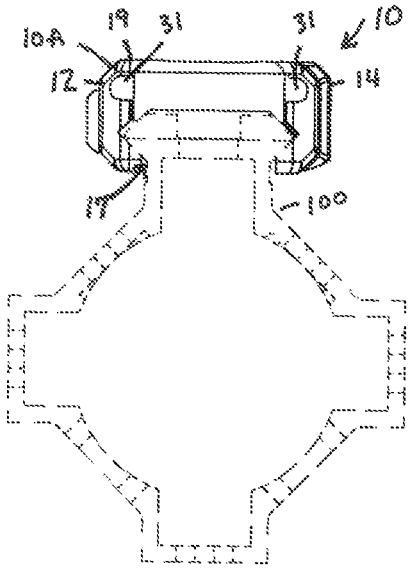
FIG. 8 is a front view of the mounting bracket illustrated in FIG. 6.
Figure 9:
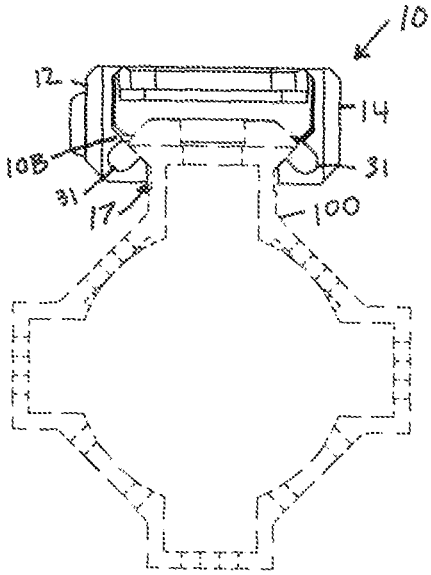
FIG. 9 is a front view showing an alternate embodiment of the mounting bracket of FIG. 6.

In the illustrated examples, the one or more cable passages 30 may be advantageously formed on an upper portion 10A of the first and second ends 12, 14 of the switch slot 16, immediately below the overhang 19 (best seen in FIG. 8); or, the one or more cable passages 30 may be formed on an upper portion 10B of the first and second ends 12, 14 of the rail attachment feature 17 (see FIG. 9).

Figure 7:
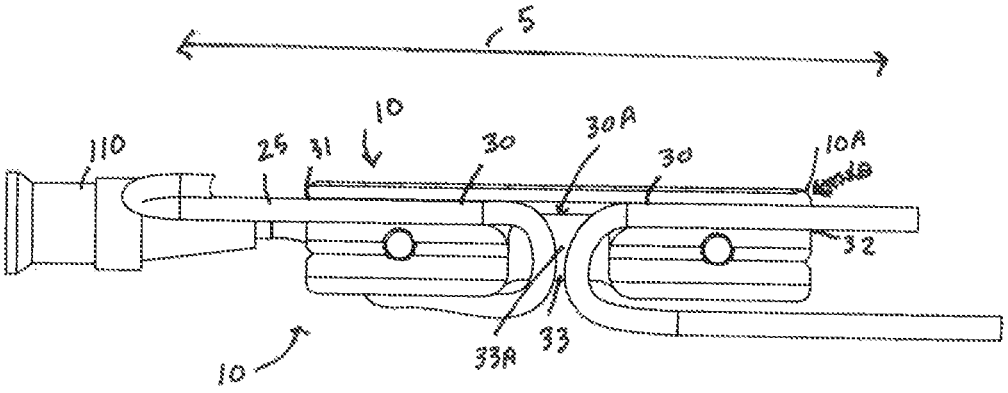
FIG. 7 is a side sectional view of the mounting bracket of FIG. 6, illustrating a selected pathway for maintaining the tape switch's cable.

As stated, each cable passage 30 extends the entire length of the mounting bracket 10 and is shaped to be at least partially round. Each cable passage 30 defines a first opening 31 in fluid communication with the channel 30A and a second, opposite opening 32 in fluid communication with the channel, and a central exit 33 in fluid communication with the channel 30A. Preferably, the mounting bracket 10 further includes a central exit 33 in fluid communication with the channel 30A and disposed between the first and second openings 31, 32. As best shown in FIG. 7, the central exit 33 defines a second channel 33A that is perpendicular to the longitudinal axis 5 and again, in fluid communication with the channel 30A.

Figure 6:
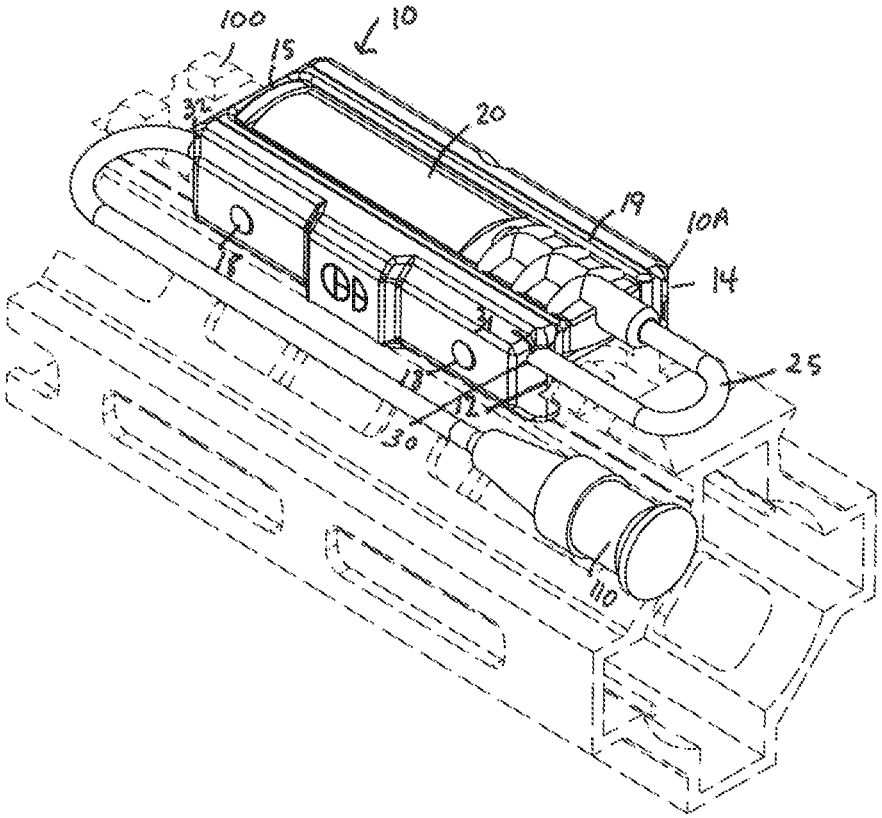
FIG. 6 is a perspective view of the mounting bracket and further illustrates application of the bracket's cable passage.

As illustrated, the cable 25 may, for example, extend from the tape switch 20 and directed into the first opening 31 of the cable passage 30, extend through the channel 30A and exit through the second opening 32 and connect to the accessory 110 (see FIG. 6). Alternatively, the cable 25 may selectively extend from the tape switch 20 and directed into the first opening 31 of the cable passage 30, extend through the channel 30A and through second channel 33A and exit through the central exit 33 and connect to the accessory 110 (see FIG. 7).

FIGS. 1 and 2 show the rail attachment feature 17 which is beneath or at an adjacent angle to the switch slot 16, whereby the rail attachment feature 17 consists of an indention on the bottom side of the tape switch mounting bracket 10. The rail attachment feature 17 can be configured to fit a variety of rail systems including the Picatinny or MIL-STD 1913 Accessory Mounting rail for small arms, KeyMOD or M-Lok rails.

The tape switch mounting bracket additionally consists of at least (2) apertures 18 for attachment to the rail mounting bracketing system and at least two (2) apertures 23 for attachment of accessories. Each rail mounting system has its own unique fastening methods and requires some standard and some specialized fasteners to hold the tape switch bracket secure to the rail mounting system. The tape switch mounting bracket 10 is able to be configured to account for the various rail mounting systems.

Figure 3:
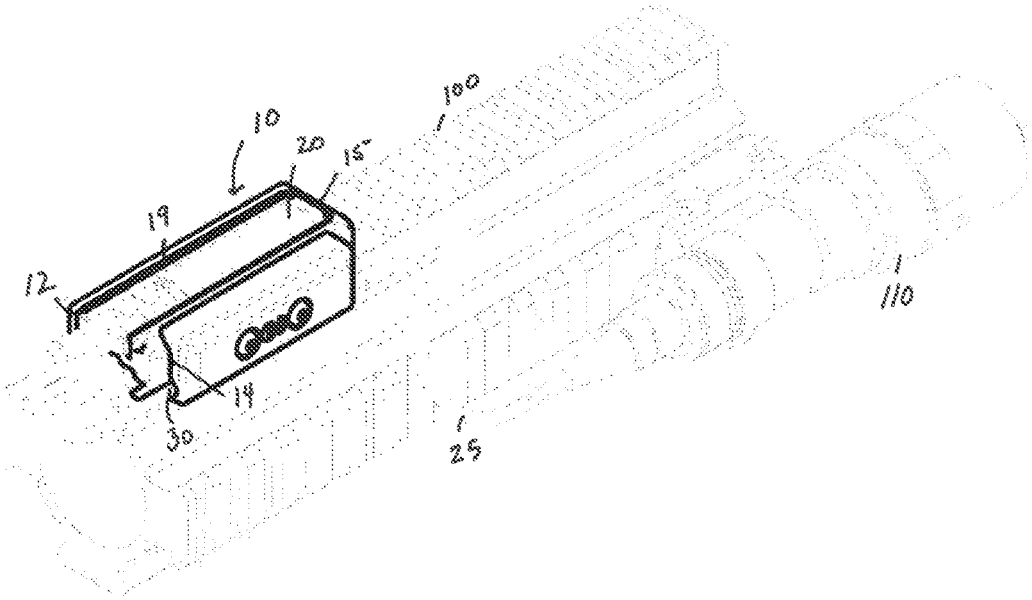
FIG. 3 illustrates the tape switch mounting bracket attached to a MIL-STD 1913 or Picatinny accessory mounting rail for small arms with a tape switch and tape switch accessory inserted into the tape switch mounting bracket.
Figure 4:
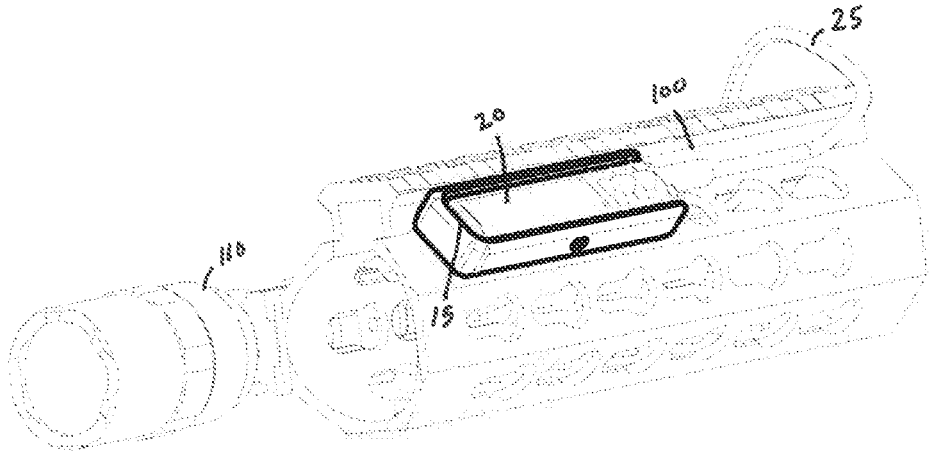
FIG. 4 illustrates the tape switch mounting bracket attached to a KeyMod accessory mounting rail for small arms with a tape switch and tape switch accessory inserted into the tape switch mounting bracket.
Figure 5:
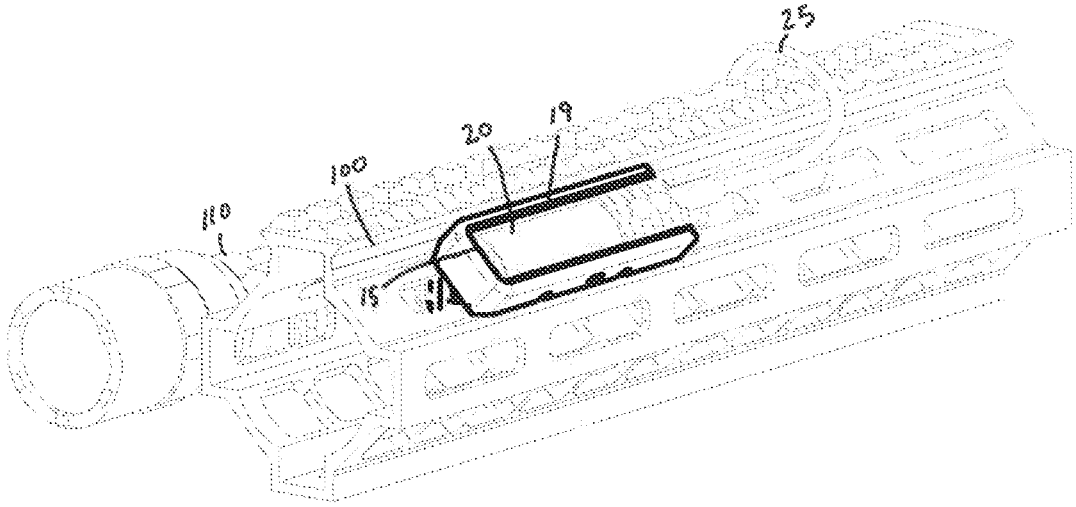
FIG. 5 illustrates the tape switch mounting bracket attached to a M-Lok accessory mounting rail for small arms with a tape switch and tape switch accessory inserted into the tape switch mounting bracket.

FIGS. 3, 4 and 5 show the tape switch mounting bracket 10 on the three most prevalent rail mounting systems in the firearm industry. These figures are not intended to account for all rail mounting systems in the firearm industry. Moreover, the patent intent is to provide a secure method of mounting a tape switch.

The tape switch mounting bracket 10 is a preferred 2.5 inches in total length and is preferred to be made of military grade aluminum due to its durability, light weight and response to anodized coatings which increase the bracket's durability and add corrosion resistance, and can make the bracket non-reflective. Further, the tape switch mounting bracket can position the tape switch at a 45 degree angle to the rail systems via brackets made with a 45 degree offset in either right-hand or left-hand versions depending on the end user's preference.

The preferred embodiments as described herein allow the entire apparatus to be securely held in a constant position on the rail system for the end user which resolves the issue of movement seen with other means of attachment for tape switches. Additionally, the preferred embodiments of the entire apparatus allows the tape switch to be held securely in a constant position through the use of friction and when needed allows the end user to simply and easily remove the tape switch without removing the tape switch mounting bracket from the firearm.

Although the description above contains many specifications, these should not be construed as limiting the scope of the invention but as merely providing illustrations of some of the presently preferred embodiments of this invention.

We claim:

1. A tape switch mounting bracket for a firearm, comprising:

a mounting bracket having first and second side walls, a switch slot disposed on a top side, and a rail attachment disposed on a bottom side of said bracket, and wherein said bracket defines a length, and said switch slot extends said length;

and wherein said first side wall, defines a channel sized and shaped for sliding receipt of a tape switch, and said rail attachment is adapted for releasably attaching to a rail mounting system for said firearm;

and wherein at least one side wall includes a cable passage configured to receive a cable of said tape switch, and wherein said cable passage is parallel to a longitudinal axis and is either disposed above a base surface of said switch slot or below an upper surface of said rail attachment and extends said length.

2. The apparatus of claim 1, wherein said cable passage includes a first opening and an opposite opening.

3. The apparatus of claim 2, wherein said cable passage is in communication with a center exit disposed between said first and opposite openings.

4. The apparatus of claim 3, wherein said center exit defines a passage that is perpendicular to said cable passage.

5. The apparatus of claim 1, wherein said mounting bracket is a one-piece bracket.

6. A mounting bracket for a firearm, comprising:

a bracket member having first and second side walls, an end wall, and an opening opposite said end wall, a switch slot disposed on a top side of said bracket member, and a rail slot disposed on a bottom side of said bracket member, and wherein said first and second side walls and said end wall define a height, and said bracket member defines a length;

and wherein said first and second side walls, said end wall and a bottom surface define a channel, and wherein said channel extends said length and an upper most end of said first and second side walls include an upper edge having a lip that extends over said channel;

and wherein said first side wall includes a cable passage that is parallel to a longitudinal axis and is either disposed above a base surface of said switch slot or below an upper surface of said rail slot and extends said length.

7. The apparatus of claim 6, wherein said cable passage having a first opening and an opposite opening.

8. The apparatus of claim 7, wherein said cable passage is in communication with a center exit disposed between said first and opposite openings.

9. The apparatus of claim 8, wherein said center exit defines a passage that is perpendicular to said cable passage.

10. The apparatus of claim 9, wherein said lip is perpendicular to said height.

11. A mounting bracket for a firearm, comprising:

a one-piece bracket having first and second side walls, an end wall, a switch slot disposed on an upper side, and a rail slot disposed on a bottom side, and wherein said one-piece bracket defines a length, and wherein said switch slot extends said length, and said first side wall includes a cable passage that is parallel to a longitudinal axis and is either disposed above a base surface of said switch slot or below an upper surface of said rail slot and extends said length.

12. The apparatus of claim 11, wherein said cable passage includes a first opening and a second opening.

13. The apparatus of claim 12, wherein said cable passage defines a first channel, and wherein said first and second openings are in fluid communication with said first channel.

14. The apparatus of claim 13, wherein said cable passage includes a third opening disposed between said first and second openings.

15. The apparatus of claim 14, wherein said third opening defines a second channel that is in fluid communication with said first channel.

16. The apparatus of claim 15, wherein said first channel is parallel to said longitudinal axis and said second channel is perpendicular to said longitudinal axis.

* * * * *